United States Patent [19]

Brücher

[11] 4,220,321

[45] Sep. 2, 1980

[54] SWIVELING MECHANISM PARTICULARLY FOR TAPHOLE PLUGGING DEVICES

[75] Inventor: Eberhard Brücher, Siegen, Fed. Rep. of Germany

[73] Assignee: Dango & Dienenthal Maschinebau GmbH, Siegen, Fed. Rep. of Germany

[21] Appl. No.: 35,773

[22] Filed: May 3, 1979

[30] Foreign Application Priority Data

May 24, 1978 [DE] Fed. Rep. of Germany ..... 2822605

[51] Int. Cl.[2] ..... C21B 7/12

[52] U.S. Cl. ..... 266/271; 266/273

[58] Field of Search ..... 266/45, 271, 272, 273

[56] References Cited

U.S. PATENT DOCUMENTS

| | | | |
|---|---|---|---|
| 3,709,477 | 1/1973 | Baumes et al. | 266/273 |
| 3,765,663 | 10/1973 | Legille et al. | 266/273 |
| 4,033,565 | 7/1977 | Ueno et al. | 266/273 |
| 4,057,234 | 11/1977 | Brücher | 266/272 |

*Primary Examiner*—L. Dewayne Rutledge
*Assistant Examiner*—Peter K. Skiff
*Attorney, Agent, or Firm*—Young & Thompson

[57] ABSTRACT

A taphole plugging device has an extension arm which can be swiveled about a fixed axis by a drive train operated by a motor. At its end remote from its pivot, the extension arm carries the plugging gun. The drive train and motor for the extension arm are all carried by the extension arm and act between the point on the extension arm spaced from the pivot of the extension arm, on the one hand, and a fixed support on which the extension arm is swingable, on the other hand.

7 Claims, 8 Drawing Figures

SWIVELING MECHANISM PARTICULARLY FOR TAPHOLE PLUGGING DEVICES

Figure 1:
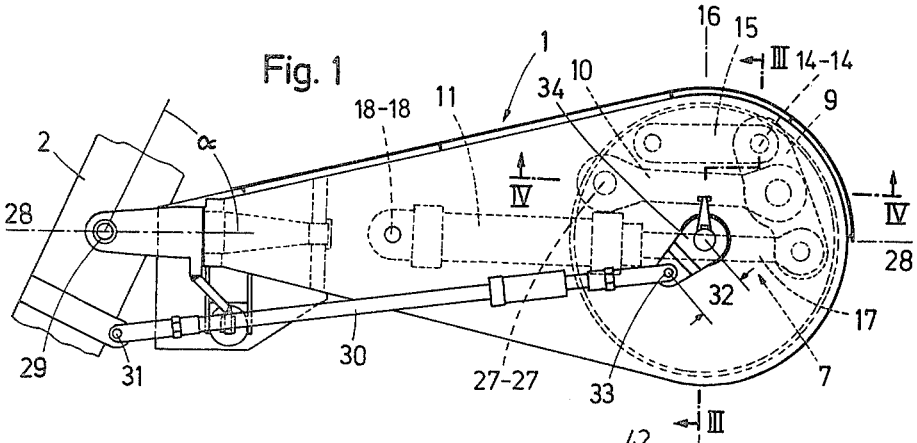

The invention relates to a swiveling mechanism for machines which can be swiveled into an operating position and a rest position, especially for taphole plugging devices with an extension arm, which latter can be swiveled by a motor and carries a plugging gun for plugging up the tapholes of blast furnaces, low shaft furnaces, or similar smelting furnaces.

Taphole plugging machines are utilized for sealing the tapholes of reducing or smelting furnaces, especially blast furnaces, for pig iron production. During the plugging step, the plugging gun is pressed by means of a swiveling mechanism with great force against the furnace breast, the contact pressure of the plugging device being maintained until the plastic plugging compound, forced into the taphole opening of the furnace by the plugging gun, has hardened.

Conventional taphole plugging devices are equipped with various swiveling means serving for swiveling the plugging gun from a rest position remote from the taphole of the furnace into the operating position and to return the plugging gun into its rest position after the plugging step has been completed. A swiveling device for a taphole plugging machine known from German Pat. No. 2,035,697 comprises an extension arm with a plugging gun, this arm being mounted pivotably to a base frame at its end remote from the plugging gun, as well as a dual-acting hydraulic cylinder pivotably mounted to a support of the base frame, the piston rod of this cylinder engaging an arm arranged radially to the swivel axis of the extension arm. During the pivoting motion of the plugging gun from the operating position into the rest position or vice versa, the direction of motion of the operating piston of the swivel cylinder is reversed when exceeding the dead center position defined by the swivel axis of the extension arm and the fixed point of articulation of the swivel cylinder. The significant disadvantages in this swivel device are to be seen in the necessity of reversing the motion and the expensive space requirement for the swivel drive mechanism, as well as in the fact that the swivel drive mechanism is in an exposed position in the proximity of the taphole, where the environmental conditions affected by heat, dust, and aggressive gases can trigger operating disturbances of the swivel drive mechanism.

German Pat. No. 1,192,224 discloses a taphole plugging machine of a similar construction, wherein the extension arm is pivotable about an axis inclined to the vertical, so that the tilting device, used in a swivel mechanism with a vertical swivel axis, for aligning the plugging gun in the direction of the taphole at the end of the swiveling motion from the rest position into the operating position, is thus eliminated. The swivel drive mechanism of this taphole plugging machine likewise requires a relatively large amount of space.

In another swiveling device known from DOS [German Unexamined Laid-Open Application] 2,157,712, the swiveling of the extension arm from the rest position into the operating position and vice versa and the forcing of the plugging gun against the taphole are executed by means of a hydraulic cylinder pivotably mounted to the base of the pivot bearing of the extension arm; this hydraulic cylinder acts on the supporting arm by way of a connecting element fashioned as an articulated lever.

The latter is formed from a U-shaped bracket and a leg connected thereto, wherein the piston rod of the hydraulic cylinder engages the bracket, one end of the latter being rotatable about a fixed pivot axis, and the free end of this bracket being rotatably joined to the leg. The leg engages the supporting arm of the extension arm by means of a rotary coupling. Besides the extensive space requirement, the primary disadvantage of this conventional swivel drive mechanism resides in the unfavorable torque curve of the extension arm during the swiveling step, caused by the kinematics of the articulation chain employed. When the extension arm approaches the plugging position during pivoting from the rest position into the operating position, the torque rises unproportionately due to the mode of operation of the articulated lever, which operates in the manner of a toggle lever. The torque of the extension arm and the resultant, very high contact pressure of the plugging gun increase still further, if the swiveling device must be swiveled further, past the theoretical engagement point of the plugging gun, by a follow-up path in the direction toward the center of the furnace, if the taphole engagement point has traveled in the direction toward the center of the furnace due to wearing of the refractory furnace lining and repairs thereof, which are required from time to time. The super-proportionately increasing contact pressure, which can assume theoretically the value of infinity in case of a large follow-up path, leads to damage to the furnace brickwork and to the plugging gun.

A further disadvantage of plugging machines with an inclined swiveling device, as known, for example, from German Pat. No. 1,192,224, resides in the unfavorable torque characteristic of the swivel drive mechanism as compared to the torque actually needed during the swiveling step. This mode of operating the taphole plugging machine entails a considerable energy waste.

The invention has the objective of counteracting the above-described disadvantages of the conventional taphole plugging machines by developing a compact swiveling device with a swivel drive mechanism, the torque characteristic of which is adapted to the respectively required torque over the swiveling range of the extension arm.

This objective has been attained by the invention, starting with a swiveling device of the type described hereinabove, by providing that the entire swivel drive mechanism is accommodated within the extension arm.

According to another feature of the invention, the swivel drive mechanism generates a torque of the extension arm which varies with the swivel angle of the extension arm in correspondence with the actual torque requirement and assumes a maximum, predetermined value in the zone of the plugging position of the extension arm.

In a suitable embodiment of the invention, the swivel drive mechanism of the extension arm comprises a lever system arranged in the zone of the longitudinal plane of the extension arm, with a pivot lever, one end of which is rotatable about a pivot axle fixedly arranged in the base of the pivot bearing of the end of the extension arm facing away from the plugginggun; this pivot axle is disposed on the side of the transverse axis of the extension arm extending perpendicularly to the swivel axis of the extension arm, this side facing away from the plugging gun. The other end of the pivot lever is acted upon by the piston rod of a dual-acting swivel cylinder, the latter being rotatable about a pivot axle fixedly installed in the extension arm. The lever system further comprises a guide fishplate engaging the pivot lever, the point of articulation of this fishplate being determined at one end by the selected lever transmission; the other end of the fishplate is rotatable about a pivot axle fixedly installed in the extension arm, wherein the pivot axles of the swivel cylinder and of the guide fishplate are arranged on the side, facing the plugging gun, of the transverse extension arm axis at a spacing to the swivel axis of the extension arm.

The invention furthermore provides that the swivel axes of the swivel cylinder and of the guide fishplate have a certain mutual distance.

Preferably, the swivel axis of the swivel cylinder is arranged in the zone of the longitudinal axis of the extension arm.

According to another feature of the invention, the ends of the guide fishplate are fashioned to be bifurcate. Furthermore, the invention provides that the extension arm is fashioned in a manner known per se as an arm having the shape of a housing.

Another expedient embodiment of this invention resides in that the swivel axis of the extension arm is conventionally inclined with respect to the vertical.

An important feature of the invention, finally, is to be seen in that the working stroke of the swivel cylinder is prolonged by a follow-up stroke, to enlarge the range of the plugging position of the extension arm by increasing the swivel angle of the extension arm by a follow-up angle.

The swiveling mechanism of this invention for taphole plugging devices is distinguished in that its space requirement is substantially lower than in case of the conventional taphole plugging devices, due to the fact that all drive elements of the swivel drive mechanism are accommodated in the housing-like extension arm. Further decisive advantages of the novel swiveling mechanism are to be seen in that the torque characteristic of the extension arm, effected by the swivel drive mechanism, is adapted over the entire swiveling range to the torque characteristic required for swiveling the extension arm, and that the torque of the extension arm within the follow-up path, by means of which the operating position of the plugging gun is corrected in case of a migration of the taphole, is almost constant and assumes a predetermined value.

Figure 2:
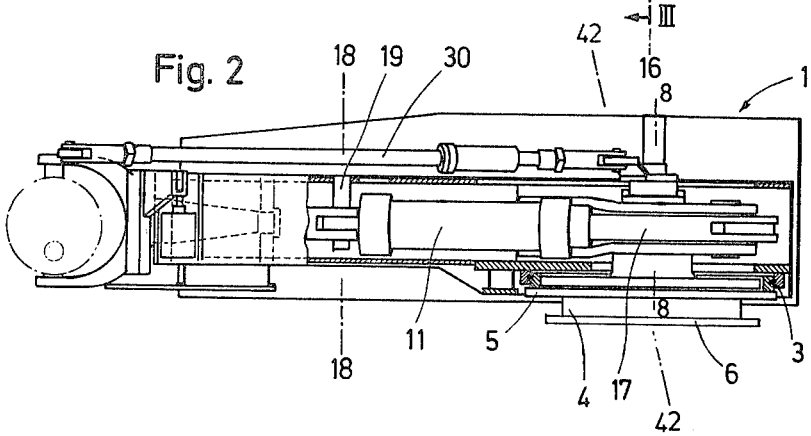
Figure 8:
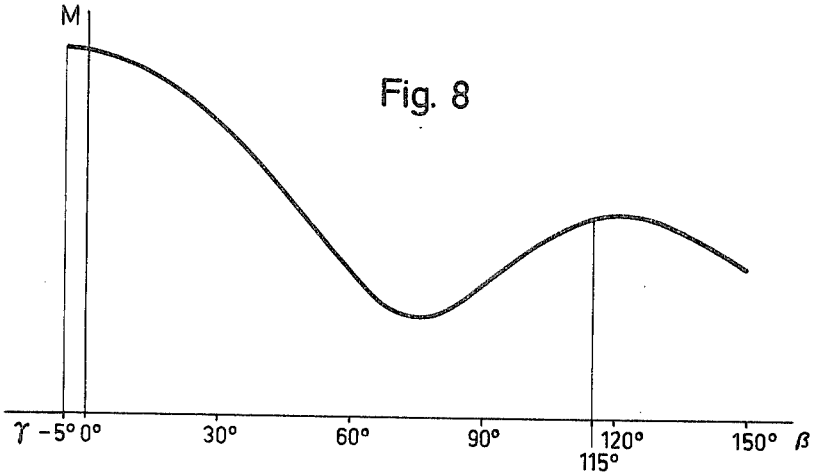
Figure 3:
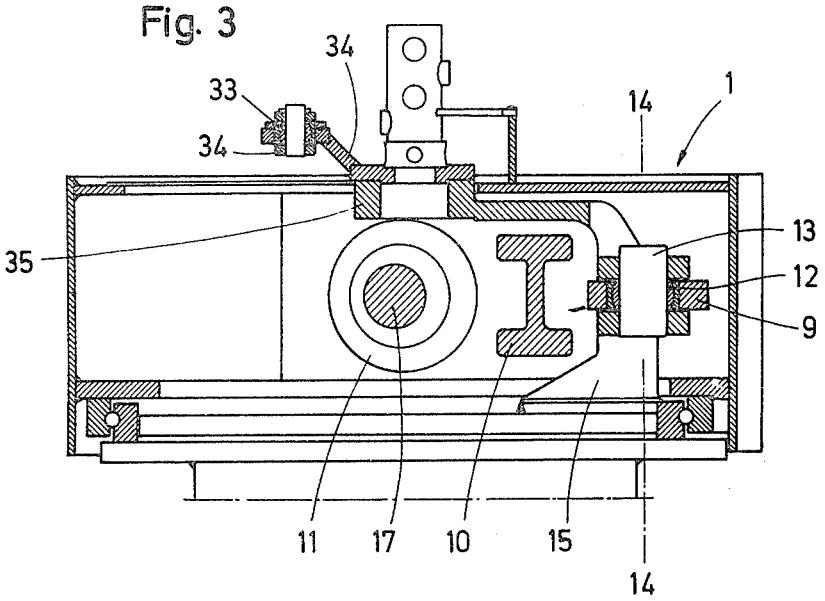
Figure 4:
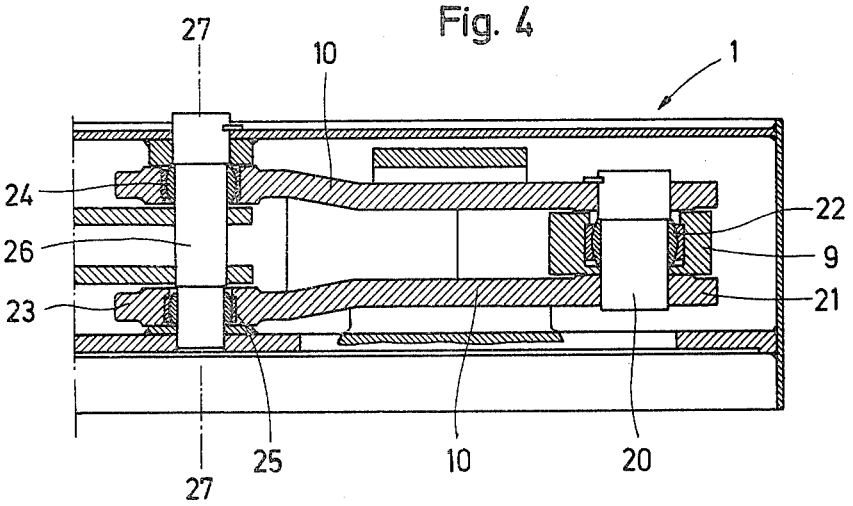
Figure 5:
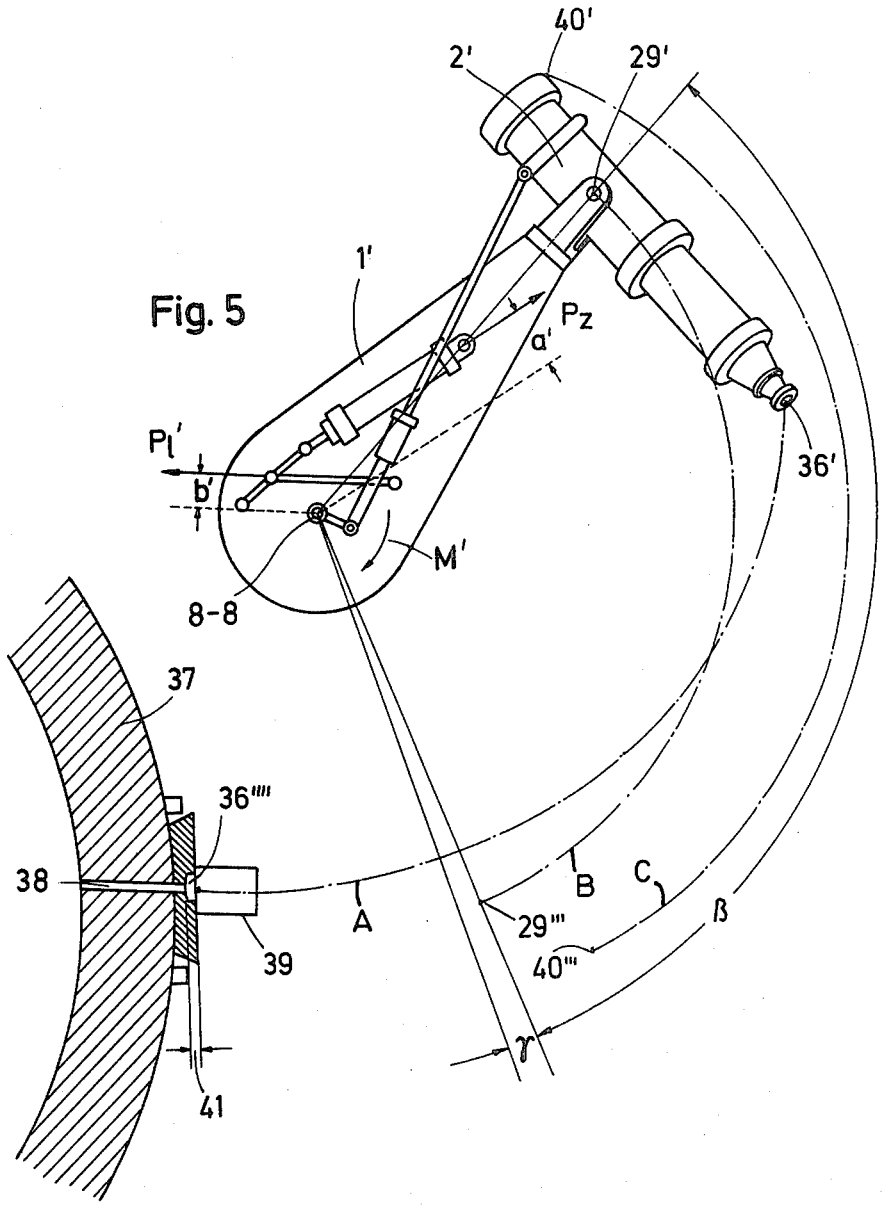
Figure 6:
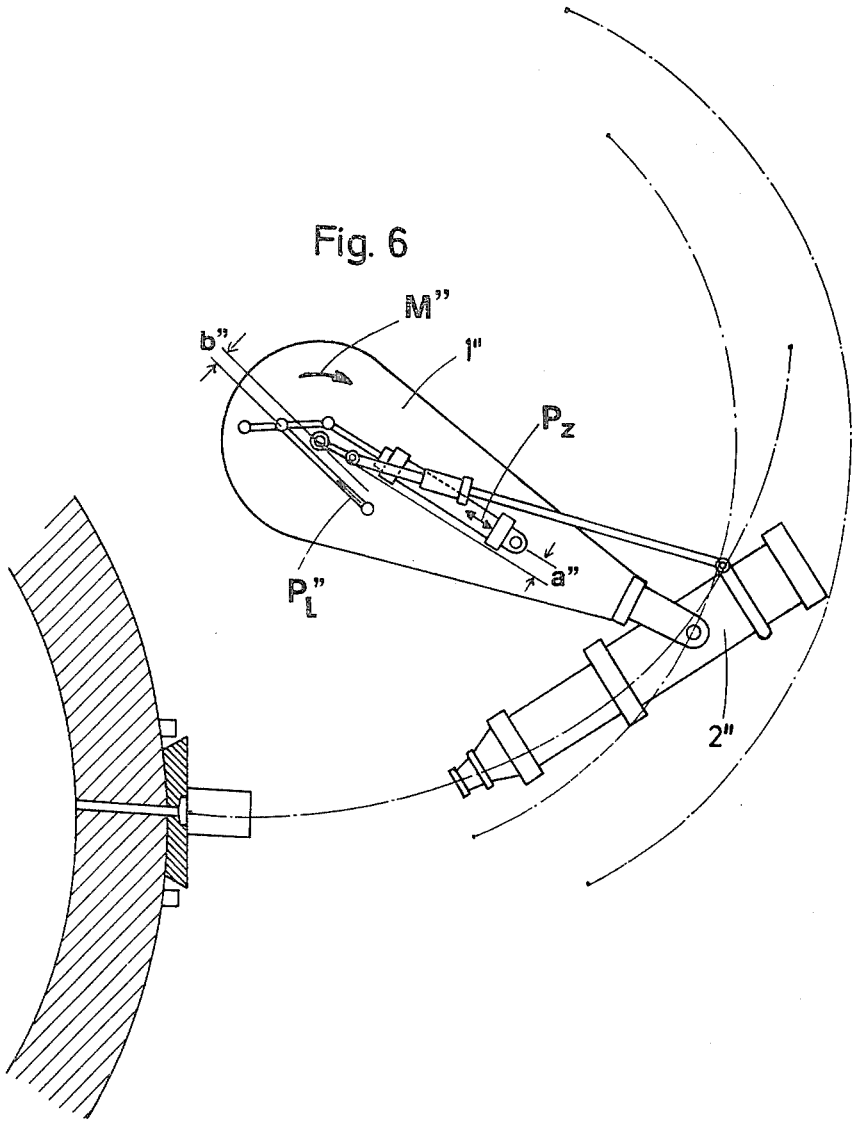
Figure 7:
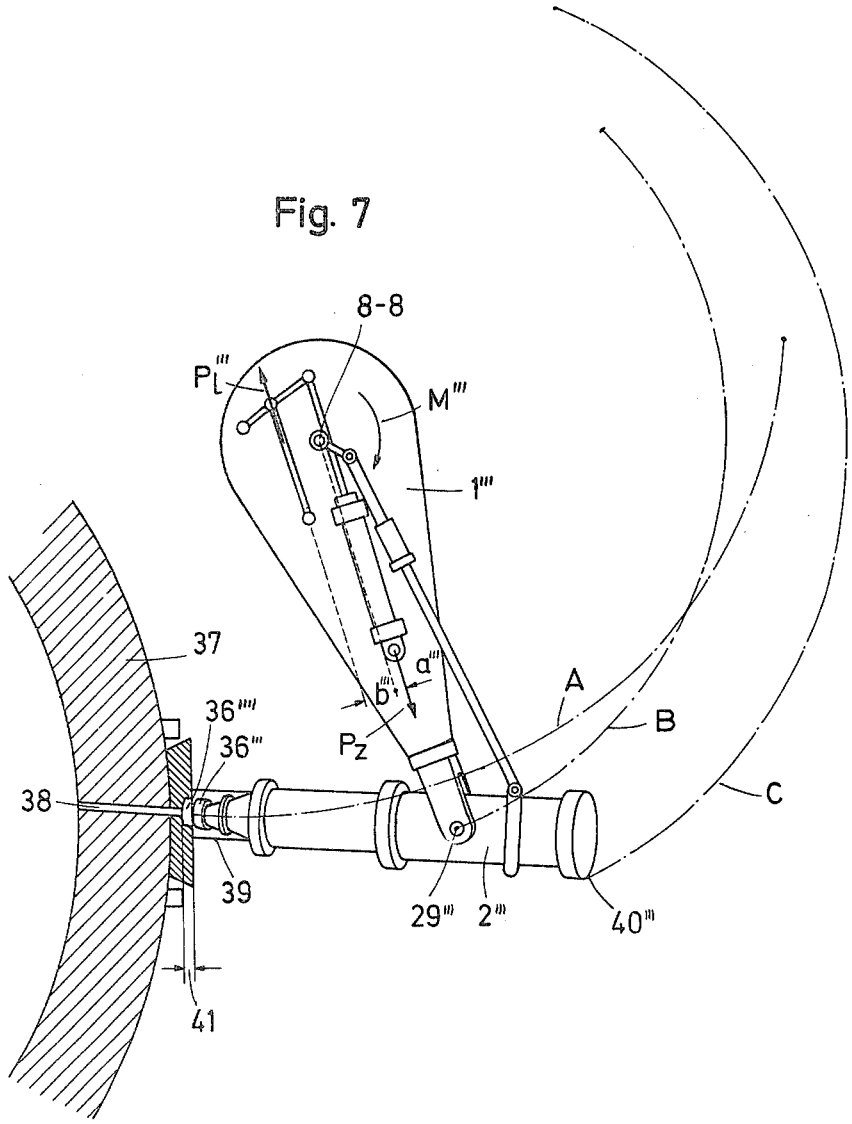

The invention will be explained in detail below with reference to an embodiment illustrated in the drawings, to wit:

FIG. 1 is a top view of the swiveling mechanism in the operating position,

FIG. 2 is a lateral view of the swiveling mechanism of FIG. 1 with an illustration of the hydraulic drive means partially in a sectional view, FIG. 3 is a section through the swiveling mechanism along line III—III in FIG. 1 on an enlarged scale, FIG. 4 is a section along line IV—IV in FIG. 1 on an enlarged scale, FIGS. 5–7 show the rest position, an intermediate position, as well as the operating position of a taphole plugging device equipped with the swiveling mechanism of this invention, in a schematic top view, and FIG. 8 shows the torque curve of the extension arm of the swiveling mechanism in dependence on the swivel angle.

The taphole plugging device according to FIGS. 1–4 comprises a housing-shaped extension arm 1, which, as seen in the drawings, comprises a hollow casing the plugging gun 2 being pivotably mounted to the free end thereof. The fixed end of the extension arm 1 is pivotably supported by means of a ball bearing rotary joint 3 on the supporting plate 5 of a stand 4 with a horizontal base plate 6. The stand 4 is anchored with its base plate 6 to a linear foundation, not shown, in such a way that the extension arm 1 of the plugging gun 2 is pivotable in a horizontal swivel plane by means of the swivel drive mechanism 7 about the vertical swivel axis 8—8.

The entire swivel drive mechanism 7 for the swiveling means of the plugging gun 2 is installed in the extension arm 1 and comprises as the main components a lever system with a pivot lever 9 as well as a guide fishplate 10, this system being driven by a dual-acting hydraulic cylinder 11. The lever system of the swivel drive means 7 is arranged in the zone of the longitudinal plane of the extension arm. One end of the pivot lever 9 is pivotably supported by means of a rocker bearing 12 about a hinge pin 13 with a pivot axis 14—14. The hinge pin is held in a bearing 15, which latter is attached on the side, facing away from the plugging gun 2, of the transverse extension arm axis 16—16 extending perpendicularly to the swivel axis 8—8 of the extension arm, on the supporting plate 5 of the stand 4. At the free end of the pivot lever 9, the piston rod 17 of a dual-acting swivel cylinder 11 engages, this cylinder being rotatable about a swivel axis 18—18 constituted by a pivot pin 19 fixedly installed in the extension arm 1. A guide fishplate 10 engages the pivot lever 9 via a hinge with a hinge pin 20, the latter being fixedly seated in the end of the guide fishplate 10 fashioned as a fork 21, as well as with a rocker bearing 22, the inner ring of which is arranged on the hinge pin 20, and the outer ring of which is held in the pivot lever 9. The point of articulation of the guide fishplate 10 at the pivot lever 9 is fixed by the selected lever transmission. The other end of the guide fishplate 10, fashioned as a fork 23, is pivotable by means of rocker bearings 24, 25 about a hinge pin 26 fixedly installed in the extension arm 1, this hinge pin forming a swivel axis 27—27. The swivel axis 18—18 of the swivel cylinder 11, located preferably on the longitudinal axis 28—28 of the extension arm, and the swivel axis 27—27 of the guide fishplate 10 are arranged on the side of the transverse extension arm axis 16—16 facing the plugging gun 2 at a spacing to the swivel axis 8—8 of the extension arm and at a specific mutual distance.

The lateral angle $\alpha$ of the plugging gun 2, connected to the free end of the extension arm 1 via a joint 29, toward the longitudinal extension arm axis 28—28 is adjustable by means of a length-adjustable control rod 30, one end of this rod engaging the rear end of the plugging gun via a joint 31 and the other end of this rod being pivotably mounted, via a joint 33 arranged at the eccentricity 32 with respect to the swivel axis of the extension arm denoted by 8—8, to a bearing plate 34. The bearing plate is held by a bracket 35 attached to the bearing 15 fixedly connected to the machine stand.

The mode of operation of the swiveling mechanism is illustrated with the aid of FIGS. 5–7. By extending the operating piston of the hydraulic swivel cylinder 11, the extension arm 1 is swiveled by the swivel angle $\beta$ about the extension arm swivel axis 8—8, the plugging gun 2 thus passing from the rest position 2' via an intermediate position 2'' into the plugging position 2''', wherein the orifice 36 in its position 36''' enters the taphole 38 in the furnace wall 37, this taphole being arranged above the tap troughs 39. During the swiveling motion of the extension arm 1, the orifice 36 of the plugging gun 2 describes the motion curve A; the connecting joint 29 between the plugging gun 2 and the extension arm 1 moves along curve B; and the outermost contour point 40 of the plugging gun 2 travels along curve C. During the extension of the piston rod 17 of the hydraulic cylinder 11 at the beginning of the inward pivoting motion of the plugging gun 2, the cylinder force $P_Z$ exerts a moment with a right-hand rotation $$M_Z' = P_Z \cdot a'$$

on the extension arm 1, wherein a' is the vertical spacing between the operating line of the cylinder force $P_Z$ and the swivel axis 8—8 of the extension arm. At the same time, the cylinder force $P_Z$ exerts, via the guide fishplate 10, a fishplate force $P_L$ on the extension arm 1, effecting a moment with a left-hand rotation on the extension arm 1, $$M_L' = P_L' \cdot b'$$

wherein b' is the perpendicular distance between the line of action of the fishplate force $P_L'$ and the pivot axis 8—8 of the extension arm 1. The resultant torque of the extension arm 1, oriented toward the right, at the beginning of the inward swiveling step is $$M' = M_Z' - M_L'$$

In the intermediate operating position 2'' of the plugging gun, the cylinder force $P_Z$ exerts on the extension arm 1 a moment in a direction toward the right $$M'' = P_Z \cdot a'',$$

and
the fishplate force $P_L$ exerts a moment oriented toward the right $$M_L'' = P_L'' \cdot b''$$

so that the resultant, right-turning torque of the extension arm is $$M'' = M_Z'' + M_L''$$

In the plugging position 1''' of the extension arm 1 according to FIG. 7, the right-oriented moments result $$M_Z''' = P_Z \cdot a'''$$

and $$M_L''' = P_L''' \cdot b'''$$

as well as the resultant, right-oriented moment $$M''' = M_Z''' + M_L'''$$

The diagram of FIG. 8 shows the curve of the torque M of the swiveling mechanism by way of example over a swivel angle $\beta$ of 115° and 150°, respectively, wherein the extension arm 1 assumes the rest position 1' at 115° and 150°, respectively, and occupies the operating position 1''' at 0°. The diagram demonstrates that the torque of the extension arm 1, when pivoting inwardly from the rest position into the operating position of the plugging gun, decreases initially over a certain swivel range from a medium value to a lower value and then, in the operating position of the plugging gun, attains a maximum value. In case of an inclined pivot axis 42—42 of the extension arm 1 (FIG. 2), the force and torque relationships remain essentially the same.

When the taphole 38 migrates in the direction toward the center of the furnace, the working stroke of the swivel cylinder 11 is extended by a follow-up stroke, so that the swivel range $\beta$ of the extension arm 1 is increased by the follow-up angle $\gamma$ and consequently the orifice 36 of the plugging gun is swiveled further toward the direction of the center of the furnace into the brickwork 37 by the follow-up path 41 into position 36''''. In this connection, the follow-up path 41 corresponds to the migration of the taphole 38.

The curve of motion A of the orifice 36 of the plugging gun 2 is controlled by the extension arm 1 and the control rod 30 so that the curve A terminates tangentially above the tap trough 39 in the taphole 38 only at the end of the swiveling motion of the extension arm 1 from the rest position into the operating position. Consequently, the impingement of molten iron exiting from the furnace onto the orifice 36 of the plugging gun before the latter enters the taphole 38 is maximally avoided and thus damage to the orifice of the plugging gun, leading to disturbances in the operation, is prevented. When the plugging gun 2 is swiveled from the operating position 2''', corresponding to a swivel angle of $\beta = 0°$ into the rest position 2' with a swivel angle $\beta$ of, for example 115°, a left-oriented torque $-M$ is effected on the extension arm.

What is claimed is:

1. In a taphole plugging device a fixed support, an extension arm comprising a hollow casing pivotally mounted on said support, swivel drive means including a motor to swivel the extension arm and a plugging gun carried by the extension arm for sealing the tapholes of furnaces; the improvement in which the entire swivel drive means (7) is housed in said casing, the swivel drive means (7) of the extension arm (1) comprising a lever system arranged in the zone of the longitudinal plane of the extension arm, with a pivot lever (9), one end of which is rotatable about a pivot axis (14—14) fixed relative to said support, a pivot bearing (3) connected to the end of the extension arm (1) facing away from the plugging gun (2), said pivot axis (14—14) being disposed on the side facing away from the plugging gun (2) of the transverse extension arm axis (16—16) extending perpendicular to the extension arm pivot axis (8—8), the other end of said pivot lever (9) being pivotally connected to the piston rod (17) of a dual-acting swivel cylinder (11) rotatable about a swivel axis (18—18) fixed relative to the extension arm (1); said swivel drive means further comprising a guide fishplate (10) pivotally connected to the pivot lever (9), said fishplate being pivotally connected at one end to said pivot lever and at the other end being rotatable about a swivel axis (27—27) fixed relative to the extension arm (1), the pivot axes (18—18, 27—27) of the swivel cylinder (11) and the guide fishplate (10) being disposed on the side facing the plugging gun (2) of the transverse extension arm axis (16—16) at a spacing with respect to the extension arm swivel axis (8—8).

2. A device according to claim 1, in which the swivel drive means (7) is so arranged as to generate a torque (M) of the extension arm (1) varying with the swivel angle ($\beta$) of the extension arm (1) in correspondence with the actually required torque and having, in the zone of the plugging position (1''') of the extension arm (1), a maximum value which is approximately constant over a follow-up angle ($\gamma$).

3. A device according to claim 1, in which the pivot axes (18—18, 27—27) of the swivel cylinder (11) and of the guide fishplate (10) are spaced apart.

4. A device according to claim 1, in which the swivel axis (18—18) of the swivel cylinder (11) is adjacent the longitudinal extension arm axis (28—28).

5. A device according to claim 1, in which the ends of the fishplate (10) are bifurcated (21, 23).

6. A device according to claim 1, in which the swivel axis (42—42) of the extension arm (1) is inclined with respect to the vertical.

7. A device according to claim 1, in which the working stroke of the swivel cylinder (11) is extended by a follow-up stroke to enlarge the plugging position range of the extension arm (1) by increasing the swivel angle ($\beta$) of the extension arm by a follow-up angle ($\gamma$).

* * * * *